United States Patent [19]

Kubbota et al.

[11] 4,419,433

[45] Dec. 6, 1983

[54] PHOTOGRAPHIC MATERIAL

[75] Inventors: Massashi Kubbota; Touru Noda, both of Tokyo, Japan

[73] Assignee: Mitsubishi Paper Mills, Ltd., Tokyo, Japan

[21] Appl. No.: 424,298

[22] Filed: Sep. 27, 1982

[30] Foreign Application Priority Data

Dec. 3, 1981 [JP] Japan ..... 56-195038

[51] Int. Cl.[3] ..... G03C 1/06; D21D 3/00

[52] U.S. Cl. ..... 430/206; 430/538; 430/566; 430/536; 162/158

[58] Field of Search ..... 430/538, 566, 531, 532, 430/206; 162/158

[56] References Cited

U.S. PATENT DOCUMENTS 3,671,248 6/1972 Eldridge et al. ..... 430/538

*Primary Examiner*—Mary F. Downey

[57] ABSTRACT

The present invention relates to a photographic material containing at least one kind of silver halogenide developer in at least one stratum of photograph-constructing layer provided on a support prepared by coating a paper base material with a film-formable resin wherein said paper base material for support is treated with at least one member selected from the group consisting of aminomethanesulfonic acid and its salts. When it is used, the discoloration in said photographic material can be prevented.

24 Claims, No Drawings

PHOTOGRAPHIC MATERIAL

This invention relates to a photographic material, and more particularly to a photographic material which is prevented from the discoloration by the influence of silver halogenide (silver halide) developer.

Usually, a photographic-material is constructed of a support and a photograph-constructing layer (photograph-constitution layer) provided on said support. Such photograph-constructing layer comprises a silver halogenide photographic emulsion layer, a protecting layer, a subbing layer, an intermediate layer or scavenger containing layer provided between emulsion layers, a halation-preventing (anti-halation) layer or filter layer, an ultraviolet absorbing layer containing ultraviolet absorber, an image-receiving layer containing physical development speck (nuclei) for diffusion transfer process, and the alike and usually their combinations. Particularly a photograph-constructing layer wherein at least one of silver halogenide photographic emulsion layers exists, is called a silver halogenide photograph-constructing layer, and a photographic material prepared by providing a silver halogenide photograph-constructing layer on a support is called a silver halogenide photographic material. For example, in a single type of silver halogenide photographic material, a silver halogenide photographic emulsion layer and its protecting layer are provided on a support. In multi-layer type of silver halogenide color photographic material, a blue-sensitive silver halogenide photographic emulsion layer and an intermediate layer, a green-sensitive silver halogenide photographic emulsion layer and an ultraviolet absorbing layer, a red-sensitive silver halogenide photographic emulsion layer and a protecting layer, and so on are provided on a support adjacently in succession to give a multilayer arrangement. In case of particular photographic materials such as photographic material for diffusion transfer process used in a combination of a pair of silver halogenide photographic material and image-receiving material as mentioned in Japanese Patent Publication Nos. 11,093/63, 27,568/64 and 43,778/76, the image-receiving material has on a support a photograph-constructing layer containing at least one image-receiving layer.

In the recent years, there is a more increasing demand in the photographic industry for an effective photographic material capable of fulfilling the requirements concerning photographic treatments such as more rapid and more simple development of photographic material, improvement in the durability of photographic treating solutions, and so on, as well as the requirements concerning photographic characteristics such as promotion of the developing ability of silver halogenide photographic emulsion, improvement of sensitivity, hardening of color tone (gradation), improvement in sharpness or resolution, and so on. As photographic material capable of coping with such requirements, there have been many kinds of photographic materials wherein a photograph-constructing layer containing silver halogenide developer is provided on a photographic support which is a resin-coated paper, i.e. a base paper composed mainly of natural pulp coated with a film-formable resin (usually, polyolefin resin). The first reason for this trend is that such type of photographic material contain a silver halogenide developer in its photograph-constructing layer and therefore it exhibits a more rapid and more effective developing effect from the early stage of development, as compared with photographic materials not containing it. The second reason for this trend is that, since the resin-coated paper used as photographic support is hydrophobic, permeation of treating solutions into base paper layer cannot take place in the course of developing or fixing photographic material so readily as in the case of baryta paper hitherto used as photographic support and therefore the treating time for washing with water and drying can be shortened.

However, it has been discovered that a photographic material constructed of a resin-coated paper (prepared by coating a base paper composed mainly of natural pulp with a film-formable resin) and a photograph-constructing layer containing a silver halogenide developer provided thereon has an important fault. Thus, when such a photographic material is stored after preparation, color of the photographic material changes to yellow, yellowish brown or reddish yellow as the time period of storage becomes long particularly at a high temperature and high humidity. The discoloration is particularly clearly noticeable when the photographic material is observed from the side opposite to the photograph-constructing layer. As the result of the study of the present inventors, the followings have become apparent. In the first place, the discoloration occurs not only in the photograph-constructing layer containing silver halogenide developer but also in the base paper layer composed mainly of natural pulp, and the discoloration cannot be lightened substantially even after photographic material is subjected to development and fixation. In the second place, the discoloration is not noticeable substantially when the photograph-constructing layer contains no silver halogenide developer. In the third place, the discoloration of support is not noticeable in a photographic material prepared by providing the photograph-constructing layer containing silver halogenide developer on a support composed of so-called synthetic paper. As above, this discoloration is considered due to interaction between resin-coated paper, prepared from paper as a base, as a support and the silver halogenide developer contained in the photograph-constructing layer provided on the support, and due to the effect of silver halogenide developer under such an interaction, though its exact mechanism is not yet elucidated. At any rate, this discoloration causes stains on the white background of photograph and image, causes deterioration of photographic characteristics and thereby markedly injures its commercial value.

Accordingly, the object of this invention consists in preventing the discoloration of photographic material containing at least one silver halogenide developer in at least one stratum of photograph-constructing layer provided on a support prepared by coating base paper with a film-formable resin, and thereby providing an excellent photographic material which can be subjected to developing treatment with a high efficiency and a high workability and has improved photographic characteristics and high whiteness.

As the result of elaborated studies of the present inventors, it was found that the object of this invention can be achieved by using as said base paper the paper treated with at least one of aminomethanesulfonic acid and the salt thereof.

It was also found that, in the photographic material of this invention, not only the discoloration in the base paper layer of resin coated paper serving as support can be prevented to a remarkable extent, but also the discoloration in the photograph-constructing layer containing silver halogenide developer can also be prevented to a remarkable extent, which is an entirely surprising effect. This invention is based on these entirely new facts.

As the salt of aminomethanesulfonic acid usable in this invention, alkali metal (lithium, sodium, potassium and the like) salts of aminomethanesulfonic acid, alkaline earth metal (calcium, strontium, barium and the like) salts of aminomethanesulfonic acid, ammonium salt of aminomethanesulfonic acid, and the like can be referred to. Base paper material may be treated either with a solution prepared by dissolving these salts or with a salt solution prepared by dissolving aminomethanesulfonic acid and then adjusting pH of the solution. Of course, it is also allowable to use aminomethanesulfonic acid not in the form of salt but in the form of acid itself. When aminomethanesulfonic acid is used in the form of a salt, the kind of salt is not limited to the examples presented above.

As the process for treating base paper material with aminomethanesulfonic acid or its salt, employable in this invention, the process of adding aminomethanesulfonic acid or its salt at the time of preparing stuff slurry can be referred to. More advantageously, however, it is added in the step of paper-making by means of size press, tub size, spray or the like. Coating by means of air-knife coater, roll coater, gravure coater, blade coater or the like is also employable. Though the amount of aminomethanesulfonic acid or its salt used for treatment is not particularly limited, it is preferably 50 mg or more per 1 $m^2$ of base paper material.

The term "silver halogenide developer" used in this invention means a compound which can develop silver halogenide when treated with a development activator such as alkaline solution, and it involves a precursor for silver halogenide developer. Concrete examples of silver halogenide developer include hydroquinone compounds such a hydroquinone, methylhydroquinone, 2,5-dimethylhydroquinone, trimethylhydroquinone, 2-chlorohydroquinone, 2-phenylhydroquinone, 2-tert-butylhydroquinone, 2,5-di-tert-butylhydroquinone, 2,5-di-tert-octylhydroquinone and the like; polyhydric phenol compounds such as catechol, 4-tert-butylcatechol, pyrogallol and the like; 3-pyrazolidone compounds such as 1-phenyl-3-pyrazolidone, 1-(m-tolyl)-3-pyrazolidone, 1-phenyl-2-acetyl-3-pyrazolidone, 1-phenyl-4-methyl-3-pyrazolidone, 1-phenyl-4,4-dimethyl-3-pyrazolidone, 1-phenyl-4-methyl-4-hydroxymethyl-3-pyrazolidone, 1-p-chlorophenyl-4-methyl-4-hydroxy-3-pyrazolidone, 1-(p-tolyl)-4,4-dihydroxymethyl-3-pyrazolidone, 1-phenyl-4-hydroxymethyl-3-pyrazolidone and the like; aminophenol compounds such as p-aminophenol, 2-amino-4-methylphenol, Metol from Agfa, 4-hydroxyphenylaminoacetic acid and the like; aminohexose reductone compounds such as dimethylaminohexose reductone, di-n-butylaminohexose reductone, morpholinohexose reductone, piperazinohexose reductone and the like; amino-naphthalenediol compounds such as 4-amino-1,4-dihydroxynaphthalene, 2-amino-1,5-dihydroxynaphthalene and the like; 4-aminoaniline compounds such as p-phenylenediamine, 4-(N,N-diethyl)-aminoaniline, 4-(N-ethyl-N-hydroxyethyl)-aminoaniline, 4-(N-ethyl-N-$\beta$-methylsulfonaminoethyl)-amino-2-methylaniline, 4-(N-ethyl-N-hydroxyethyl)-amino-2-methylaniline and the like, their hydrochlorides, their sulfates, their tetraphenylboron salts and the like; hydrazine; hydroxylamine; naphthalenediol and the like; and so on. Concrete examples of said precursor for developer include 4-chloroacetyloxy-hydroquinone, hydroquinone monoacetate, 1,4-dichloroacetyloxy-hydroquinone, 1,4-diacetyloxyhydroquinone, catechol monobenzoate, 2-methylhydroquinone monoacetate, hydroquinone monobenzoate, 2-methoxyhydroquinone monobenzoate and the like. However, the developer used in this invention is not limited by the above-mentioned silver halogenide developers. Silver halogenide developer may be added in itself alone or in combination. For example, a combined use of hydroquinone compound and 3-pyrazolidone compound is useful.

The silver halogenide developer used in this invention is incorporated into at least one of silver halogenide photographic emulsion layer, protecting layer, subbing layer, intermediate layer, scavenger containing layer, halation-preventing (anti-halation) layer or filter layer, ultraviolet absorbing layer, image-receiving layer and the like and combinations thereof in the photograph-constructing layer provided on support. From the viewpoint of developing effect of photographic material, however, it is particularly useful to incorporate said silver halogenide developer into the silver halogenide photographic emulsion layer of the silver halogenide photographic material. If necessary, it may be incorporated also into other layer than silver halogenide photographic emulsion layer in the photograph-constructing layer. Inversely, it is also allowable to incorporate it only into other layer than silver halogenide photographic emulsion layer in the photograph-constructing layer, in accordance with use and purpose. In the case of particular photographic materials such as photographic material for diffusion transfer process, it is also allowable to incorporate 3-pyrazolidone compound and hydroquinone compound into separate photographic materials. For example, it is allowable to incorporate 3-pyrazolidone compound into a photograph-constructing layer of silver halogenide photographic material and hydroquinone into a photograph-constructing layer of image-receiving material. In incorporating a silver halogenide developer into a photograph-constructing layer, it is advantageous to add the silver halogenide developer into the hydrophilic colloidal coating solution for photograph-constructing layer at the time of preparing the photographic material. As the method for adding it, a method which comprises dissolving silver halogenide developer into a solvent such as water, methanol, ethanol, propanol, isopropanol, acetone, methyl ethyl ketone, benzene, dioxane or the like and adding the solution to the coating solution for photograph-constructing layer; oil protection method which comprises dissolving silver halogenide developer into a high-boiling solvent such as di-n-nonyl phthalate, tricresyl phosphate or the like or, if necessary, a mixture of said high-boiling solvent and a low-boiling solvent such as ethyl acetate, cyclohexane or the like, emulsifying the resulting solution into other hydrophilic colloidal solution in the presence of a surfactant, and then adding the emulsion into the coating solution for photograph-constructing layer; resin latex method which comprises dissolving silver halogenide developer into a low-boiling solvent, absorbing the resulting solution into a resin latex, and then adding the resin latex to the coating solution for photograph-constructing layer; and the like are advantageous.

The amount of silver halogenide developer incorporated into photograph-constructing layer is to be determined in the actual place dedending on the kind of silver halogenide developer, the kind and use of photographic material, characters such as composition, crystal traits, particle size, crystal form, etc. of silver halogenide in the silver halogenide emulsion layer, characters of silver halogenide emulsion such as silver ion concentration, pH, kind of binder, etc., the kind of stabilizer used in silver halogenide emulsion and other additives used therein such as anti-fogging agent, sensitizing dyestuff, film-hardening agent and the like, and it is not particularly limited. However, the amount of silver halogenide developer is usually 5 g/m$^2$ or less, and preferably 3 g/m$^2$ or less in the case of hydroquinone compound and 1 g/m$^2$ or less in the case of 3-pyrazolidone compound.

The photographic materials to which this invention is effectively applicable are not particularly limited in kind and use. The concrete examples include silver halogenide black and white photographic print, silver halogenide color photographic material, multilayer silver halogenide color photographic material, silver halogenide photographic material and image-receiving material for diffusion transfer process (for example, the materials mentioned in Japanese Patent Publication Nos. 11,093/63, 27,568/64 and 43,778/76), direct positive type silver halogenide photographic material, general photographic printing papers, photographic printing paper for phototype-setting, printing paper for copying, material for block copy, materials for printing (including, for example, the material mentioned in Japanese Patent Publication No. 30,562/73) and the like.

Although the base paper material (hereinafter, simply referred to as "base paper") used in this invention is composed mainly of natural pulp, it is also allowable to use those papers made from a mixture of natural pulp and other synthetic pulp or synthetic fiber, if necessary. As the natural pulp, advantageously usable are wood pulps such as coniferous wood pulp, hardwood pulp and coniferous wood-hardwood mixture pulp which have been subjected to usual bleaching such as chlorine bleaching, hypochlorite bleaching or chlorine dioxide bleaching and alkali treatment or alkali extraction and optionally peroxide bleaching with hydrogen peroxide, peracetic acid or the like or their combinations. Kraft pulp, sulfite pulp, soda pulp and the like, as well as a pulp prepared by using anthraquinone compound as a digesting assistant and the like, can also be used for the purpose.

A variety of high-polymeric compounds and additives can be incorporated into the base paper composed mainly of natural pulp, used in this invention, at the time of preparing stuff slurry. For example, it is advantageous to incorporate appropriate combinations of dry paper strength improver such as cationated starch, cationated polyacrylamide, anionated polyacrylamide, carboxy-modified polyvinyl alcohol, gelatine and the like; sizing agent such as fatty acid salt, rosin, maleinated rosin or other rosin derivatives, alkenyl- or alkylsuccinic acids, their salts and acid anhydrides, dialkylketene dimer emulsion, petroleum resin emulsion and the like; filler such as clay, kaolinite, calcium carbonate, barium sulfate, titanium dioxide, aluminum hydroxide, magnesium hydroxide and the like; wet paper strength improver such as melamine resin, urea resin, epoxidated polyamide resin and the like; fixing agent such as aluminum sulfate, aluminum chloride and other polyvalent metal salts; pH regulator such as sodium hydroxide and the like; dyes; fluorescent whitening agent; and so on. For making the base paper, conventional paper-making machines such as wire paper machine, cylinder paper machine and the like are used.

It is advantageous to spray, tub size or size press the base paper composed mainly of natural pulp used in this invention with a solution containing various water-soluble high-polymeric compounds or additives. As said water-soluble high-polymeric compounds and additives, there are advantageously used for example, water-soluble high-polymeric compound such as cationated starch, polyvinyl alcohol, carboxy-modified polyvinyl alcohol, carboxymethyl cellulose, hydroxyethyl cellulose, cellulose sulfate, gelatine, casein, sodium polyacrylate, sodium salt of styrenemaleic anhydride copolymer, sodium salt of polystyrenesulfonate and the like; sizing agent such as petroleum resin emulsion, ammonium salt of styrene-maleic anhydride copolymer alkyl ester, alkylketene dimer emulsion and the like, and latices or emulsions of styrene-butadiene copolymer, ethylene-vinyl acetate copolymer, polyethylene, vinylidene chloride copolymer and the like; inorganic electrolytes such as sodium chloride, sodium sulfate and the like; hygroscopic substances such as glycerine, polyethylene glycol and the like; pigments such as clay, kaolinite, talc, barium sulfate, titanium oxide and the like; pH regulator such as hydrochloric acid, phosphoric acid, sodium hydroxide, sodium carbonate and the like. They are used optionally in combination of dyes, fluorescent whitening agents, and so on.

Although kind and thickness of the base paper composed mainly of natural pulp, used in this invention, are not particularly limited, a base paper having a good surface flatness and smoothness prepared by, for example, compressing the paper with calender after papermaking is preferable. Its basis weight is preferably 40 g/m$^2$ to 250 g/m$^2$.

The film-formable resin used in this invention is not particularly limited, and any resin can be used so far as it can produce a resin film coating on base paper, of which examples include homopolymers such as polyolefins; polystyrene, polyvinyl chloride, polyacrylic esters, linear polyesters (for example, polyethylene terephthalate), polycarbonate, polyamides (for example, nylon), cellulose esters, polyacrylonitriles and the like, copolymers such as ethylenevinyl acetate copolymer and the like, and their mixtures. However, polyolefin resins are particularly advantageous in point of extrusion coating property, adhesion to base paper and cost. As used in this invention, the term "polyolefin resins" means olefin homopolymers such as low density polyethylene, high density polyethylene, polypropylene, polybutene, polypentene and the like, copolymers of two or more olefins such as ethylene-propylene copolymer and the like, and their mixtures. Polyolefin resins having various densities and melt indices (hereinafter, simply referred to as MI) can be used either alone or in the form of mixture.

Preferably, various additives including white-colored pigment such as titanium oxide, zinc oxide, talc, calcium carbonate and the like; aliphatic acid amide such as stearic acid amide, arachidic acid amide and the like; metallic salt of fatty acid such as zinc stearate, calcium stearate, aluminum stearate, magnesium stearate, zirconium octanoate, sodium palmitate, calcium palmitate, sodium laurate and the like; antioxidant such as tetrakis[methylene-3-(3,5-di-tert-butyl-4-hydroxyphenyl)-propionate]-methane, 2,6-di-tert-butyl-4-methylphenol and the like; blue-colored pigments and dyes such as cobalt blue, iron blue pigment, ultramarine blue pigment, cerulean blue, phthalocyanine blue and the like; magenta-colored pigment such as cobalt violet, fast violet, manganese violet and the like; fluorescent whitening agent such as bis(tert-butylbenzoxazole)-thiophene, bis(methylbenzoxazole)-naphthalene and the like; ultraviolet absorbers such as Tinubin 320, Tinubin 326, Tinubin 328 (trade names of Ciba Geigy Ltd.) and the like; and so on are incorporated into the film-formable resin used in this invention in the form of appropriate combinations. As the process for adding these additives to resin (preferably, polyolefin resin), melt blending process by means of not kneading roll, Banbury mixer, kneader, kneading extruder or the like is most preferable. It is allowable to use a beforehand prepared compound comprising intended compounding ratios of all ingredients, and it is also allowable to prepare many master batches comprising each ingredients at high concentration and then to blend the master batches at intended ratio.

The resin-coated paper used in this invention is usually produced by the so-called extrusion-coating process which comprises casting a hot molten resin on a running base paper, and preferably its both sides are coated with the resin. Preferably, the base paper is subjected to activating treatment such as corona discharge treatment, flame treatment or the like before it is coated with the resin. The emulsion-side surface of resin-coated paper is formed into gloss surface, matte surface, silk pattern surface or the like depending on its use, while its backside is usually unglossed. If necessary, front surface alone or both of front and back surfaces may be subjected to activating treatment such as corona discharge treatment, flame treatment and the like. Though thickness of the resin layer in resin-coated paper is not particularly limited, it is usually advantageous to subject the paper to an extrusion coating so that the thickness of resin layer comes to about 5–50 microns.

As the silver halogenide photographic emulsion in the silver halogenide photograph-constructing layer, particularly advantageously usable in this invention, a variety of emulsions can be referred to. For example, regarding the composition of silver halogenide, emulsions of silver chloride, silver bromide, silver chlorobromide, silver chloro-iodo-bromide, silver iodochloride, silver iodo-bromide and the like and emulsions comprising their mixtures can be used. Regarding crystal form and crystal traits of silver halogenide, there can be used emulsions comprising regularly shaped particles, such as cubic particles, emulsions comprising irregularly shaped particles, such as particles having twin structure, emulsions comprising particles having [1,0,0] or [1,1,1] surface or the like, emulsions comprising their mixed crystal particles (for example, mixed crystal particles having [1,0,0] and [1,1,1] surfaces) and the like. Regarding particle size and particle size distribution of silver halogenide, there can be used fine particle emulsion, coarse particle emulsion, emulsions having a broad particle size distribution and emulsions having a sharp particle size distribution (for example, monodispersed particle size distribution) and the like. Regarding pH value of emulsion, emulsions having a pH value falling in the range of 4.0–8.0 can be exmplified. Regrding silver ion concentration in emulsion, emulsions having a pAg value falling in the range of 6.0–11.0 can be exemplified. Regarding the kind of binder for silver halogenide particles, there can be used emulsions containing gelatine and emulsions containing synthetic hydrophilic binder such as polyvinyl alcohol, poly-N-vinylpyrrolidone, acrylic acid-acrylic ester-acrylamide copolymer and the like, and so on. Negative type of silver halogenide photographic emulsions can also be used. If necessary, direct positive type of silver halogenide photographic emulsions can also be used. Further, if necessary, there can also be used surface latent image type of silver halogenide photographic emulsions forming a latent image mainly on the silver halogenide particle surface, as well as inner latent image type of silver halogenide photographic emulsions.

Further, emulsions prepared by carrying out the formation, the dispersion and the first aging of silver halogenide photographic emulsion by various methods under various conditions can be used. For example, there can be used emulsions which have been prepared by various methods and conditions such as normal mixing process, reverse mixing process, simultaneous mixing process (double jet process, multi-jet process), transformed silver halogenide process mentioned in Japanese Patent Publication No. 7,772/71 and U.S. Pat. No. 2,592,520, ammonia process, acidic or neutral process, alkaline process, silver iodide nucleation process mentioned in Japanese Patent Kokai (Laid-Open) No. 65,925/73, and the like and their combinations. Further, emulsions to which various additives have been added at the time of forming or dispersing the silver halogenide photographic emulsion or in the course of or after the first aging process can be used with a particular advantage. Preferred examples are emulsions containing water-soluble rhodium compounds such as rhodium trichloride, hexahalogenorhodate and the like; hexahalogenoiridium complex salts such as hexahalogenoiridic (III) acid salt, hexahalogenoiridic (IV) acid salt and the like; water-soluble iridium compounds such as iridium (III) chloride, iridium (III) bromide and the like; water-soluble gold compounds such as gold halogenide, gold complex salts, halogenoauric acids, halogenoaurates and the like; water-soluble platinum compounds such as tetrachloroplatinate and the like; mercapto-heterocyclic compounds mentioned or shown in Japanese Patent Kokai (Laid-Open) No. 147,925/75 and No. 107,129/76; hydroxyazaindolizine compounds mentioned in Japanese Patent Kokai (Laid-Open) No. 103,018/79; water-soluble inorganic and organometallic salts of zinc, lithium, nickel and the like; and their appropriate combination. After completion of the first aging, the silver halogenide photographic emulsion is precipitated, dehydrated and then preferably washed with water until its electric conductivity and silver ion concentration reach the intended values, though product not washed with water can also be used as it is.

These silver halogenide photographic emulsions are usually put to use after various chemical sensitizations. As chemically sensitized emulsion, useful are emulsions which have been subjected to sulfur-sensitization with sensitizing gelatine containing active sulfur compound, thiosulfate or active sulfur compound; emulsions which have been subjected to seleno-sensitization by means of seleno compounds such as N,N-dimethylselenourea or the like; emulsions which have been subjected to nobel metal-sensitization by means of water-soluble compounds of noble metals such as iridium, gold, platinium and the like; emulsions which have been sensitized with polyethylene oxide derivatives; and the like. Further, emulsions can be used advantageously which have been subjected to chemical sensitization and, at the same time, to spectral sensitization or supersensitization by the use of polymethine sensitizing dyestuff such as cyanine, merocyanine, carbocyanine or the like alone or in combination or by the use of their combination with styryl dye.

Further, in this invention, silver halogenide color photographic emulsion can also be used. That is, an emulsion to which a compound (coupler) capable of reacting with oxidized product of main developing agent to form a dye has been added can also be used. Typical couplers usable for this purpose include pivaloylacetoanilide type or benzoylacetoanilide type of open-chain ketomethylene yellow couplers, pyrazolone type magenta couplers, phenol type or naphthol type of cyan couplers, their mixtures and black couplers. Couplers usable also include development inhibitor releasing couplers (DIR couplers) having analogous structures to the above-mentioned ones, and two equivalent couplers which have been subjected to —O-allyl substitution, —O-acyl substitution, hydrantoin compound substitution, urazol compound substitution, succinoimide compound substitution, monoxoimide compound substitution, pyridazone compound substitution or the like at the active cite of coupler.

As the binder or protecting colloid in the photograph-constructing layer of this invention, a variety of substances can be used. Substances usable for this purpose include lime-treated gelatine, acid-treated gelatine, gelatine derivatives such as phthalated gelatine, acylated gelatine and the like; starch and its derivatives; cellulose compounds such as carboxymethyl cellulose, hydroxyethyl cellulose and the like; synthetic hydrophilic binders such as polyvinyl alcohol, poly-N-vinylpyrrolidone, acrylic acid-acrylic ester copolymer, acrylic acid-acrylamide copolymer, acrylic acid-acrylic ester-acrylamide copolymer and the like; hydroxyl-containing natural and synthetic high-polymeric compounds such as cellulose, dextran, dextrin, alginic acid, starch, polyvinyl alcohol and the like used as a thickener for gelatine or gelatine derivative; and preferably polymers such as sulfuric esters of polysaccharides, styrene-maleic acid copolymer, alkyl vinyl ether-maleic acid copolymer and the like. These substances may be used either alone or in combination.

Advantageously, a variety of anti-fogging agents or stabilizers are incorporated into the photograph-constructing layer of this invention and particularly preferably into the silver halogenide photographic emulsion layer. Advantageous examples are hydroxyazaindolizine compounds such as those mentioned in U.S. Pat. Nos. 2,716,062 and 2,944,900; the mercapto-heterocyclic compounds mentioned or shown in Japanese Patent Kokai (Laid-Open) Nos. 102,621/73 and 107,129/76; 2-thione heterocyclic compounds; heterocyclic compounds having no mercapto group such as benzimidazole, benztriazole, 1-phenyl-tetrazole, benzoxazole, guanazole; or their combinations.

Further, various additives may be incorporated into the photograph-constructing layer of this invention. For example, as film-hardening agent, preferably used are organic film-hardening agents such as formalin, reaction product formed between formaldehyde and urea, melamine or the like, halogenocarboxylic acids, vinylsulfone compounds, aziridine compounds, epoxy compounds, active halogen compounds, acryloyl compounds, isocyanate compounds and the like, and inorganic film-hardening agents such as chromium alum, zirconium carbonate and the like. As surfactant, preferably used are anionic surfactants such as alkylbenzenesulfonic acid salts, sulfosuccinic ester salts and the like, nonionic surfactants such as saponin, alkylene oxide compounds and the like and amphoteric surfactants such as amino acids, aminosulfonic acids, aminoalcohol esters and the like. As ultraviolet absorber, benzotriazole compounds having hydroxy-dialkyl-phenyl group in 2-position and the like can be incorporated. As fluorescent whitening agent, the compounds mentioned or shown in Japanese Patent Publication No. 24,068/70, Japanese Patent Kokai (Laid-Open) No. 94,318/79, etc. can be incorporated. As sharpness improver, Edible Red No. 2, the acid dyes shown in Japanese Patent Kokai (Laid-Open) No. 14,721/72 and the like can be incorporated. As metallic ion blocking agent, ethylenediaminetetraacetic acid and the like can be incorporated. As mordant, N-guanylhydrazone compounds, quaternary onium salt compounds and the like can be incorporated. As antistatic agent, cellulose type of antistatic agents, alkali salt of polystyrenesulfonic acid, alkali salts of acrylic acid polymer and copolymers and the like can be incorporated. As matting agent, polymethyl methacrylate, polystyrene, methacrylic acid-methacrylate copolymer, colloidal silica and the like can be incorporated. As film property improver, latices composed of copolymer of acrylic ester or methyacrylic ester and other ethylene-containing monomer and the like can be incorporated.

Further, it is also allowable to incorporate development speck (nuclei) for silver halogenide complex suitable for promoting the formation of silver-containing diffusion transfer image into the image-receiving layer for diffusion transfer process. As said development speck, there can be referred to sulfides of noble metals such as silver, gold, platinum, palladium and the like; sulfides of heavy metals such as antimony, bismuth, cobalt, nickel, zinc and the like; fogged silver halogenide and the like, among which colloidal sulfides of noble metals are particularly preferable. Further it is also allowable to incorporate additives for direct positive photographic emulsion such as fog promoter, sensitizing dye for direct positive photographic emulsion and the like into the direct positive silver halogenide emulsion layer of this invention.

On the back side of the photographic material of this invention, namely on the surface of support on which photograph-constructing layer (in many cases, halogenide photograph-constructing layer) are not provided, a coating layer composed of a hydrophilic colloid layer called back-coat layer can be provided for the purpose of preventing curling, electrostatic charging, sticking and slipping. Into the back-coat layer of this invention, the binder or protecting colloid, hardening agent, antistatic agent, surfactant, matting agent, latex and the like mentioned in this specification can be incorporated. Preferably, pH of back-coat layer is adjusted to 9 or less, and more preferably 7.0 or less.

In the practice of this invention, the photograph-constructing layer is provided on support preferably by dip process, meniscus process, air knife process, slide hopper process or extrusion bar process, curtain flow process, or their combination, and then dried.

The silver halogenide photographic material of this invention is subjected to treatments mentioned in "Shashin Kankozairyo to Toriatsukai-ho" (Photographic sensitive materials and their treatments) (Goro Miyamoto, Shashin Gijutsu Koza, 2, Kyoritsu Shuppan) such as exposure to light, development, stopping, fixation, bleaching, stabilization and the like, in accordance with its kind, use and object. For example, general black and white silver halogenide photographic material is exposed to light and then developed usually by treating it with a solution containing a silver halogenide developer and an alkaline agent, though in some cases an alkaline activating solution not containing silver halogenide developer at all or substantially is used. The developed silver image is fixed and stabilized with an acidic solution at least comprising a fixing agent such as sodium thiosulfate, sodium thiocyanate or the like. Typical treating solution used for the developing treatment of photographic material for diffusion transfer process at least comprises a silver halogenide complex forming agent such as thiosulfate, an alkaline agent, a preservative such as sulfide and a silver halogenide developer, though in some cases an activating solution not containing developer at all or substantially is used. Silver halogenide color photographic material is usually exposed to light and then color-developed by treating it with an alkaline activating bath containing or not substantially containing color-developer, after which it is treated with one-bath bleaching-fixing solution at least comprising a metallic salt of aminopolycarboxylic acid (for example, ferric complex salt, cupric complex salt or the like of ethylenediaminetetraacetic acid, propylenediaminetetraacetic acid or the like) and a fixing agent such as thiosulfate. It is allowable to incorporate additives such as silver removal promoter, fluorescent whitening agent and the like into such one-bath bleaching-fixing solution.

This invention will be illustrated more concretely with reference to the following examples.

EXAMPLE 1

A mixed stuff consisting of 50 parts by weight of bleached hardwood kraft pulp and 50 parts by weight of bleached softwood sulfite pulp was beaten until its Canadian standard freeness reached 310 ml, and made into paper having a basis weight of 150 g/m$^2$ according to the following formulation: (The numerical figures in the formulation express parts by weight)

| | |
|---|---|
| Pulp | 100 |
| Cationated starch | 2 |
| Anionic polyacrylamide resin | 0.5 |
| Sodium stearate | 0.5 |
| Aluminum sulfate | An amount necessary for adjusting pH to 4.5 |
| Alkylketene dimer emulsion (the weight of ketene dimer) | 0.4 |
| Polyamidepolyamine-epichlorohydrin resin | 0.4 |

The wet paper obtained was dried by means of hot plate kept at 110° C.

The paper was impregnated with 20 g/m$^2$ of an impregnating solution having the following formulation, and dried in a thermostatted hot air oven kept at 110° C. (The numerical figures in formulation express parts by weight)

| | |
|---|---|
| Gelatine | 3 |
| Diaminostilbene-disulfonate type of fluorescent whitening agent | 0.05 |
| Blue-colored dye | 0.002 |
| Aminomethanesulfonic acid | Varying amount |
| N—NaOH aqueous solution | An amount necessary for adjusting pH to 4.5 |
| Water | An amount enough to make total quantity 100 |

The impregnated and dried base paper was treated with supercalender under a line pressure of 90 kg/cm, and then its both sides were subjected to corona discharge treatment. Then, its back side was coated to a thickness of 20μ with 1:1 mixture of high density polyethylene (density 0.96 g/cm$^3$, MI 5) and low density polyethylene (density 0.92 g/cm$^3$, MI 5) at a resin temperature of 330° C. by means of a melt extrusion coating machine. Then, its front surface was coated to a thickness of 20μ with low density polyethylene containing 12% of anatase type titanium oxide (density 0.92 g/cm$^3$ and MI 5, both values are those before addition of pigment) at a resin temperature of 330° C.

Then, the surface of the polyethylene containing titanium oxide was subjected to corona discharge treatment, after which it was coated with an emulsion prepared in the following manner and dried.

Preparation of Emulsion

In the presence of $6\times10^{-6}$ g of potassium hexachlororhodate (III), 19.2 g of silver halogenide particle was formed from silver nitrate and dispersed into 14.4 g of gelatine to obtain an acidic process silver halogenide photographic emulsion having a halogen composition AgBr/AgCl=45/55, having an average particle size of 0.6μ, sulfur-sensitized to the optimum sensitivity and composed substantially of [1,0,0] surface. It was dissolved into 420 g of 8% aqueous solution of gelatine, to which were added 6.4 cc of 0.1% solution of sensitizing dye (II) represented by the following formula:

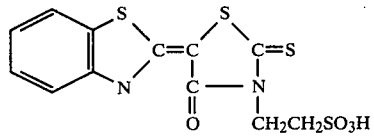

(II)

in N,N-dimethylformamide, 0.48 cc of 1% methanolic solution of 1-phenyl-5-mercapto-tetrazole and 0.48 cc of 1% methanolic solution of 1-benzoylamino-2-phenyl-5-mercapto-triazole. Then, 10 cc of 10% solution of sodium dodecylbenzenesulfonate, 20 cc of 1% aqueous solution of substituted diaminostilbenedisulfonate type fluorescent whitening agent and 16 cc of 12% aqueous solution of formaldehyde were added, and then a solution of 3.2 g of methylhydroquinone as a silver halogenide developer in 6.4 cc of isopropyl alcohol was added. Apart from it, an emulsion not containing silver halogenide developer was also prepared. Then, pH values of the emulsions were adjusted to 4.6 with pH regulator and water was added to them to adjust their total amounts to 600 g.

Each of these emulsions was multilayer-coated in a coating weight of 75 g/m$^2$ (wet base) together with an emulsion-protecting solution prepared as described below in a coating weight of 40 g/m$^2$ (wet base) on the above-mentioned polyethylene-coated paper.

Preparation of the Emulsion-Protecting Solution

To 30 g of gelatine dissolved in 300 cc of water were added 6.8 cc of 10% solution of sodium dodecylbenzenesulfonate and 18 cc of 12% aqueous solution of formaldehyde, after which the total weight was adjusted to 400 g by adding water to obtain the emulsion-protecting solution.

The samples were coated with this emulsion-protecting solution and dried, after which one of them was stored for 2 days at ordinary temperature and ordinary humidity and the other was stored for 6 days at a temperature of 50° C. at a humidity of 80%. Subsequently, they were developed with 1:2 dilution of D-72 developing solution at 20° C. for 90 seconds, stopped, fixed, washed with water and dried, and whitenesses of front and back sides of the photographic printing papers were measured by means of color difference meter. Further, storability of stored sample was evaluated by exposing it to light for sensitometric light, developing it and then measuring its photographic characteristics.

The results obtained are shown in Table 1.

TABLE 1

| No. (o: Sample of this invention) | Amount of amino-methane-sulfonic acid | Presence of developer in emul-sion | Discoloration (color change) in front and back sides of photographic printing paper | | | | Storability | |
|---|---|---|---|---|---|---|---|---|
| | | | ΔL (Note 1) | | Δb (Note 2) | | Δγ | ΔF |
| | | | Front | Back | Front | Back | (Note 3) | (Note 4) |
| 1 | — | no | −5.6 | ±0.1 or less | ±0.1 or less | ±0.1 or less | −0.4 | 0.03 |
| 2 | — | yes | −10.7 | −1.8 | 8.4 | 3.5 | −0.5 | 0.04 |
| o3 | 0.5 | " | −7.3 | −1.1 | 6.3 | 2.7 | −0.4 | 0.03 |
| o4 | 1.5 | " | −6.7 | −0.6 | 4.8 | 1.5 | −0.4 | 0.03 |
| o5 | 3.0 | " | −6.4 | −0.3 | 4.5 | 1.4 | −0.4 | 0.03 |

(Note 1) According to the color difference expression of JIS Z 8730, color tone is expressed by three values L, a and b. "L" denotes brightness, and a larger numerical value of L means a higher brightness. "a" denotes redness. A larger numerical value of "a" means a more intense redness, and a negative value of "a" means an intense greenness. "b" denotes yellowness. A greater numerical value of "b" means a more intense yellowness, and a negative value of "b" means an intense blueness. L, a and b referred to in this specification were measured by means of ND-101 DC type of color difference meter manufactured by Nippon Denshoku Kogyo. ΔL is calculated according to the following equation: ΔL = L (50° C., 80%, 6 days) - L (ordinary temp., ordinary humidity, 2 days)

(Note 2) Δb = b (50° C., 80%, 6 days) - b (ordinary, temp., ordinary humidity, 2 days)

(Note 3) γ is an index denoting the tone and hardness of photosensitive material, as is well known in the art. Δγ is given by the following equation: Δγ = γ (50° C., 80%, 6 days) - γ (ordinary temp., ordinary humidity, 2 days)

(Note 4) Fog F is reflective color density given when an unexposed surface is developed with 1:2 dilution of D-72 developer at 30° C. for 3 minutes. ΔF is given by the following equation: ΔF = F (50° C., 80%, 6 days) - F (ordinary temp., ordinary humidity, 2 days)

In this experiment, F (ordinary temp., ordinary humidity) was 0.04.

It is understandable from Table 1 that the existence of developer causes a marked yellowing and discoloration when neither aminomethanesulfonic acid nor its salt is contained in paper layer (No. 2), while the yellowing and discoloration is decreased to become substantially harmless when aminomethanesulfonic acid or its salt is used according to this invention.

The remarkably great decrease in L value of surface is due to the occurrence of fogging caused by the storage at high temperature and high humidity.

Additionally saying, the practice of this invention exercises no adverse influence on photographic characteristics.

EXAMPLE 2

The procedure of Example 1 was repeated, except that 3.2 g of methylhydroquinone used in Example 1 as silver halogenide developer was replaced with a mixture of 3.2 g of methylhydroquinone and 0.08 g of 1-phenyl-3-pyrazolidone, or 3.2 g of hydroquinone, or 3.2 g of 2,5-di-tert-butylhydroquinone, or 3.2 g of 4-benzoyloxyphenol. The results obtained were similar to those given by the use of methylhydroquinone.

What is claimed is:

1. A photographic material containing at least one kind of silver halogenide developer in at least one stratum of photograph-constructing layer provided on a support prepared by coating a base paper material with a film-formable resin, wherein said base paper material for support is a paper treated with at least one member selected from the group consisting of aminomethanesulfonic acid and its salts.

2. A photographic material according to claim 1, wherein the amount of said aminomethanesulfonic acid or its salt used for treating base paper material is 50 mg or more per 1 $m^2$ of base paper material.

3. A photographic material according to claim 1, wherein said salt of aminomethanesulfonic acid is an alkali metal salt.

4. A photographic material according to claim 3, wherein said alkali metal is lithium, sodium or potassium.

5. A photographic material according to claim 1, wherein said salt of aminomethanesulfonic acid is an alkaline earth metal salt.

6. A photographic material according to claim 5, wherein said alkaline earth metal is calcium, strontium or barium.

7. A photographic material according to claim 1, wherein said aminomethanesulfonic acid salt is an ammonium salt.

8. A photographic material according to claim 1, wherein said treatment with aminomethanesulfonic acid or its salt is carried out by means of size press, tub size or spray.

9. A photographic material according to claim 1, wherein said silver halogenide developer includes a precursor for the silver halogenide developer.

10. A photographic material according to claim 1, wherein said silver halogenide developer is a hydroquinone compound.

11. A photographic material according to claim 10, wherein said hydroquinone compound is methylhydroquinone, hydroquinone or 2,5-di-tert-butylhydroquinone.

12. A photographic material according to claim 1, wherein said silver halogenide developer is a 3-pyrazolidone compound.

13. A photographic material according to claim 1, wherein said silver halogenide developer is a mixture of a hydroquinone compound and a 3-pyrazolidone compound.

14. A photographic material according to claim 13, wherein said hydroquinone compound is methylhydroquinone and said 3-pyrazolidone compound is 1-phenyl-3-pyrazolidone.

15. A photographic material according to claim 1, wherein said silver halogenide developer is 4-benzoyloxyphenol.

16. A photographic material according to claim 1, wherein the amount of coating of silver halogenide developer is 5 $g/m^2$ or less.

17. A photographic material according to claim 10, wherein the amount of coating of said hydroquinone compound is 3 $g/m^2$ or less.

18. A photographic material according to claim 12, wherein the amount of coating of said 3-pyrazolidone compound is 1 $g/m^2$ or less.

19. A photographic material according to claim 1, wherein at least one stratum of said photograph-constructing layer is silver halogenide photographic emulsion layer.

20. A photographic material according to claim 19, wherein said silver halogenide photographic emulsion layer contains a water-soluble rhodium compound, a water-soluble iridium compound or a water-soluble gold compound.

21. A photographic material according to claim 19, wherein the layer containing silver halogenide developer is at least a silver halogenide photographic emulsion layer.

22. A photographic material according to claim 1, wherein said photographic material is a photographic material for diffusion transfer process and the photograph-constructing layer of its silver halogenide photographic material and the photograph-constructing layer of its image-receiving material both contain a silver halogenide developer.

23. A photographic material according to claim 1, wherein said film-formable resin is a polyolefin resin.

24. A photographic material according to claim 23, wherein said polyolefin resin is polyethylene.

* * * * *